US012649113B2

(12) United States Patent
Chen

(10) Patent No.: US 12,649,113 B2
(45) Date of Patent: Jun. 9, 2026

(54) OMNIDIRECTIONAL STEERING MECHANISM FOR A REMOTE CONTROL TOY CAR

(71) Applicant: Bo Chen, Shantou City (CN)

(72) Inventor: Bo Chen, Shantou City (CN)

(73) Assignee: Shantou P&C Plastic Products Company Limited, Shantou City (CN)

( * ) Notice: Subject to any disclaimer, the term of this patent is extended or adjusted under 35 U.S.C. 154(b) by 229 days.

(21) Appl. No.: 18/665,592

(22) Filed: May 16, 2024

(65) Prior Publication Data

US 2025/0213995 A1 Jul. 3, 2025

(30) Foreign Application Priority Data

Dec. 29, 2023 (CN) ..... 202311849874.X
Dec. 29, 2023 (CN) ..... 202323634595.X

(51) Int. Cl.
*A63H 17/36* (2006.01)

(52) U.S. Cl.
CPC ..... *A63H 17/36* (2013.01)

(58) Field of Classification Search
CPC ..... A63H 17/36; A63H 17/395
USPC ..... 446/460, 468
See application file for complete search history.

(56) References Cited

U.S. PATENT DOCUMENTS 3,909,276 A * 9/1975 Wolf ..... A63H 17/12 446/454
4,881,917 A * 11/1989 Suzuki ..... A63H 17/36 446/484
4,892,503 A * 1/1990 Kumazawa ..... A63H 17/004 446/460
5,762,554 A * 6/1998 Siu ..... A63H 17/395 463/37
6,827,627 B2 * 12/2004 Tsang ..... A63H 17/36 446/457
7,938,709 B2 * 5/2011 Leonov ..... A63H 17/36 446/454
8,302,728 B1 * 11/2012 Dotson ..... A63H 17/262 180/408
8,932,102 B2 * 1/2015 Wong ..... A63H 17/395 446/460
9,120,511 B1 * 9/2015 Beard ..... B60L 15/20
12,172,094 B2 * 12/2024 Miyama ..... A63H 17/36
(Continued)

*Primary Examiner* — Kurt Fernstrom

(74) *Attorney, Agent, or Firm* — Minder Law Group; Willy H. Wong

(57) ABSTRACT

The present invention discloses an omnidirectional adjustable steering mechanism of a remote-controlled toy vehicle, comprising: a plurality of steering means, each steering means comprising a steering drive means, a pivot rod, a connecting rod, at least one swivelable member, and at least one wheel bracket, with the number of swivelable members and the number of wheel brackets being equal; wherein in each steering means, the pivot rod is connected at a first end to a power output end of the steering drive means and hinged at a second end to a middle of the connecting rod, each swivelable member is swivelably mounted on a vehicle body of the remote-controlled toy vehicle. The omnidirectional adjustable steering mechanism can steer at various angles, enabling flexible control over the vehicle's driving direction, while having a simple structure and offering convenient control and adjustment operations.

7 Claims, 2 Drawing Sheets

(56) References Cited

U.S. PATENT DOCUMENTS

| | | | | |
|---|---|---|---|---|
| 2014/0227941 | A1* | 8/2014 | Suzuki | A63H 17/36<br>446/456 |
| 2018/0071646 | A1* | 3/2018 | Erhart | A63H 17/395 |
| 2020/0338464 | A1* | 10/2020 | Pipitone | G05D 1/0246 |
| 2022/0347592 | A1* | 11/2022 | Qin | A63H 17/262 |
| 2025/0213994 | A1* | 7/2025 | Chen | A63H 30/04 |

* cited by examiner

OMNIDIRECTIONAL STEERING MECHANISM FOR A REMOTE CONTROL TOY CAR

RELATED APPLICATIONS

This application claims priority to Chinese Patent Application No. 202311849874.X, filed Dec. 29, 2023; and to Chinese Patent Application No. 202323634595.X, filed Dec. 29, 2023.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention relates to the field of remote-controlled vehicles, particularly to an omnidirectional adjustable steering mechanism of a remote-controlled toy vehicle.

BACKGROUND

Remote-controlled toy vehicles have gained immense popularity among kids of all ages, attributed to their captivating entertainment value and appealing designs.

However, existing remote-controlled vehicles have limited steering angles, typically only allowing wheels to turn 18-25°, resulting in cumbersome steering and large turning radii.

Recently, remote-controlled vehicles featuring increased wheel turning angles have emerged.

For example, Chinese patent literature [Application No.: CN204121749U, Publication Date: Jan. 28, 2015] discloses a remote-controlled toy vehicle with enhanced steering maneuverability, comprising: a vehicle body, front and rear wheels, and a steering mechanism; wherein, the steering mechanism comprises: a gear case; a lateral linkage assembly connecting two front wheels and capable of steering the two front wheels; a steering motor; a transmission gear set; a steering actuator; and a rotary potentiometer; and wherein, the steering actuator consists of: an L-shaped lever integrally positioned on one side of an output gear within the transmission gear set, and a peg integrally formed with the L-shaped lever and perpendicular to a movement plane of the L-shaped lever; and wherein, the peg is up-and-down slidably connected to the lateral linkage assembly. This structure enables the remote-controlled vehicle to achieve a maximum wheel steering angle of approximately 45°.

Despite the increased steering angle, such remote-controlled vehicle still lacks omnidirectional steering adjustment, and its steering structure, as described above, is complex, occupying a significant amount of space within the vehicle body.

Currently, some remote-controlled vehicles utilizes multiple motors to independently drive each wheel, enabling steering by controlling a differential speed of each wheel. However, this method requires simultaneous control of the multiple wheel motors, making it challenging to fine-tune steering angles and only convenient for extreme steering angle adjustments (such as rotating the vehicle in place or driving sideways).

SUMMARY

An objective of one embodiment of the present invention is to provide an omnidirectional adjustable steering mechanism of a remote-controlled toy vehicle, the omnidirectional adjustable steering mechanism being able to steer at various angles, enabling flexible control over the vehicle's driving direction, while having a simple structure and offering convenient control and adjustment operations.

The objective of the present invention can be achieved by the following technical solution.

An omnidirectional adjustable steering mechanism of a remote-controlled toy vehicle, comprising:

- a plurality of steering means, each steering means comprising a steering drive means, a pivot rod, a connecting rod, at least one swivelable member, and at least one wheel bracket, with the number of swivelable members and the number of wheel brackets being equal;
- wherein in each steering means, the pivot rod is connected at a first end to a power output end of the steering drive means and hinged at a second end to a middle of the connecting rod, each swivelable member is swivelably mounted on a vehicle body of the remote-controlled toy vehicle and hinged to the connecting rod at a hinge position offset from a swivel center of the swivelable member, and each wheel bracket is fixedly connected at an upper end to a corresponding swivelable member.

In the above omnidirectional adjustable steering mechanism, each steering means controls steering of relevant wheels of the remote-controlled vehicle, a lower end or an upper end of each wheel bracket is connected to a corresponding wheel, and each swivelable member is swivelably mounted on the vehicle body and positions its swivel center at a connection point with the corresponding wheel bracket.

During a steering control, the steering drive means maneuver the connecting rod laterally. This lateral movement of the connecting rod also causes the connecting rod to move forward and backward, thereby changing an angular position of the hinge between the swivelable member and the connecting rod, with respect to the swivel center of the swivelable member. As a result, the movement of the connecting rod induces the swivelable member to swivel, leading to the swivel of the corresponding wheel brackets, thereby enabling simultaneous swivel (i.e., turning) of all corresponding wheels.

With such an omnidirectional adjustable steering mechanism, a first steering means and a second steering means can be implemented to independently steer front wheels and rear wheels respectively, or to independently steer left wheels and right wheels respectively.

Moreover, since the swivelable member is linked to a wheel via the wheel bracket rather than directly, the swivelable member and connecting rod can be positioned above or below a wheel, as well as offset from the wheel, thereby effectively circumvents constraints imposed by the wheel's position on the movement of the swivelable member and connecting rod, theoretically enabling the swivelable member to swivel 360° (It should be noted that, in practical application, swiveling the swivelable member to 180° is sufficient, resulting in a wheel turning angle of 90° to both the left and right).

Under the combined steering of the first steering means and the second steering means, the remote-controlled vehicle can achieve steering at various angles, and the steering angle can be finely adjusted as needed, making adjustment convenient.

Therefore, when using the first steering means and the second steering means to independently control steering of the front wheels and rear wheels respectively, seamless omnidirectional steering of the remote-controlled vehicle can be achieved.

In a preferred embodiment, in each steering means, a length of the pivot rod is equal to a distance from the hinge position of each swivelable member to the swivel center of the swivelable member.

In a preferred embodiment, in each steering means, each swivelable member is provided with an eccentric hole, and the connecting rod is provided with a pin shaft capable of being inserted into the eccentric hole to hinge each swivelable member and the connecting rod together.

In a further preferred embodiment, in each steering means, each swivelable member is a swivelable cylinder swivelably mounted on the vehicle body, with the eccentric hole being provided at a position offset from the swivel center of the swivelable cylinder.

In a further preferred embodiment, in each steering means, there are two swivelable members, and each of two ends of the connecting rod is hinged to the eccentric hole of the corresponding swivelable member.

In a preferred embodiment, in each steering means, the steering drive means is a servo drive or servo electric motor, and the pivot rod is connected to an output shaft of the servo drive or servo electric motor. The steering drive means adopts a commonly seen servo drive or servo electric motor, and during steering control, it operates similarly to typical remote-controlled vehicle steering mechanisms, enabling convenient adjustment of the steering angle as required.

Compared to the prior art, the present invention has the following advantages: the present omnidirectional adjustable steering mechanism of a remote-controlled toy vehicle can steer at various angles, enabling flexible control over the vehicle's driving direction, while having a simple structure and offering convenient control and adjustment operations.

DETAILED DESCRIPTION

Set forth below are specific embodiments of the present invention and a further description of the technical solutions of the present invention in conjunction with the accompanying drawings, but the present invention is not limited to these embodiments.

Embodiment I

Figure 1:
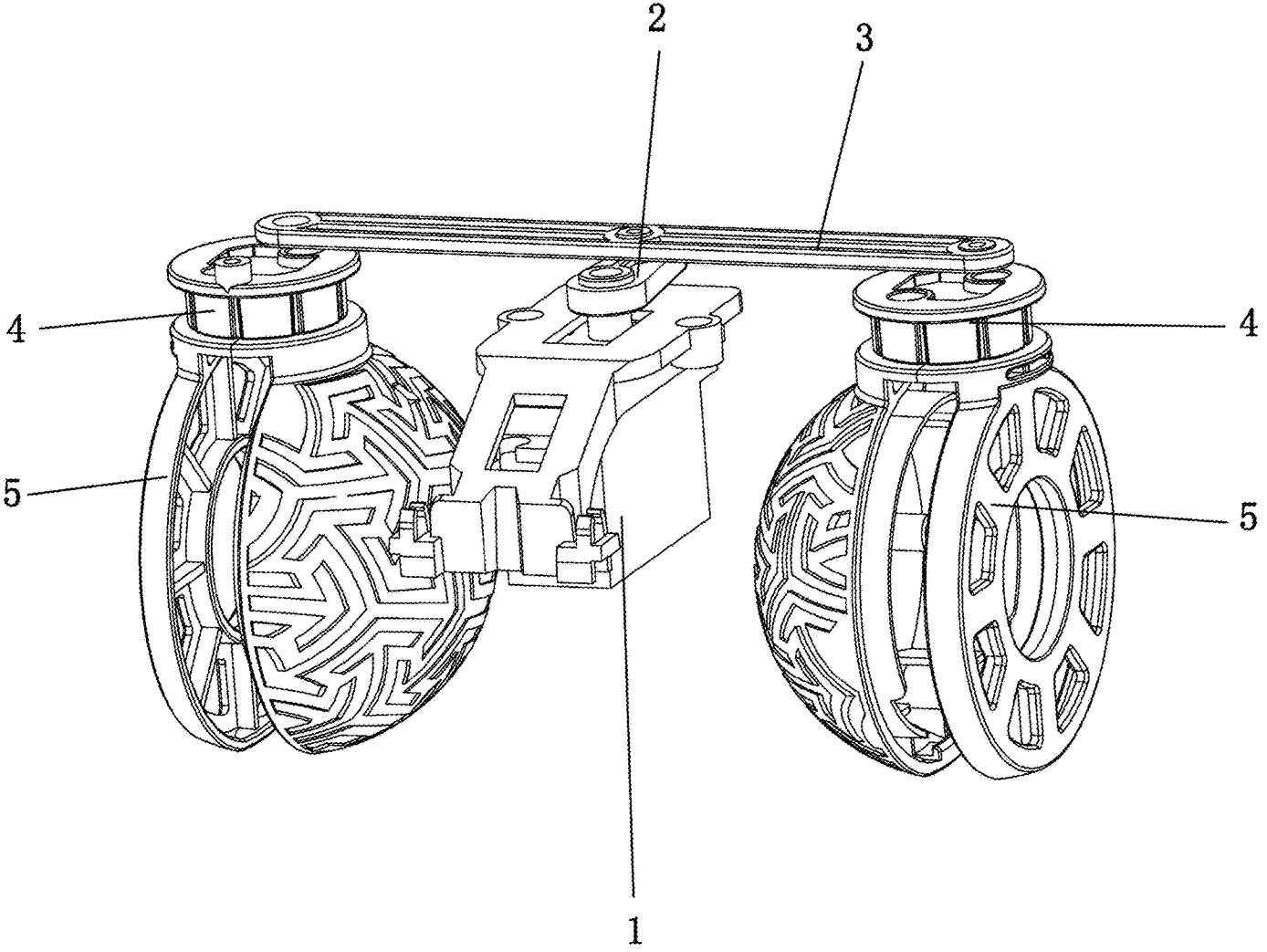
FIG. 1 is a perspective view of a steering means in Embodiment I of the present invention.

As shown in FIG. 1, one embodiment of an omnidirectional adjustable steering mechanism of a remote-controlled toy vehicle, comprises:

a first steering means and a second steering means, each steering means comprising a steering drive means 1, a pivot rod 2, a connecting rod 3, two swivelable member 4, and two wheel bracket 5, with the number of swivelable members and the number of wheel brackets being equal;

wherein in each steering means, the pivot rod 2 is connected at a first end to a power output end of the steering drive means 1 and hinged at a second end to a middle of the connecting rod 3, each swivelable member 4 is swivelably mounted on a vehicle body of the remote-controlled toy vehicle and hinged to the connecting rod 3 at a hinge position offset from a swivel center of the swivelable member 4, and each wheel bracket 5 is fixedly connected at an upper end to a corresponding swivelable member 4.

In the above omnidirectional adjustable steering mechanism, each steering means controls steering of relevant wheels of the remote-controlled vehicle, a lower end or an upper end of each wheel bracket is connected to a corresponding wheel, and each swivelable member is swivelably mounted on the vehicle body and positions its swivel center at a connection point with the corresponding wheel bracket.

During a steering control, the steering drive means maneuver the connecting rod laterally. This lateral movement of the connecting rod also causes the connecting rod to move forward and backward, thereby changing an angular position of the hinge between the swivelable member and the connecting rod, with respect to the swivel center of the swivelable member. As a result, the movement of the connecting rod induces the swivelable member to swivel, leading to the swivel of the corresponding wheel brackets, thereby enabling simultaneous swivel (i.e., turning) of all corresponding wheels.

With such an omnidirectional adjustable steering mechanism, a first steering means and a second steering means can be implemented to independently steer front wheels and rear wheels respectively, or to independently steer left wheels and right wheels respectively.

Moreover, since the swivelable member is linked to a wheel via the wheel bracket rather than directly, the swivelable member and connecting rod can be positioned above or below a wheel, as well as offset from the wheel, thereby effectively circumvents constraints imposed by the wheel's position on the movement of the swivelable member and connecting rod, theoretically enabling the swivelable member to swivel 360° (It should be noted that, in practical application, swiveling the swivelable member to 180° is sufficient, resulting in a wheel turning angle of 90° to both the left and right).

Under the combined steering of the first steering means and the second steering means, the remote-controlled vehicle can achieve steering at various angles, and the steering angle can be finely adjusted as needed, making adjustment convenient.

Therefore, when using the first steering means and the second steering means to independently control steering of the front wheels and rear wheels respectively, seamless omnidirectional steering of the remote-controlled vehicle can be achieved.

In each steering means, a length of the pivot rod 2 is equal to a distance from the hinge position of each swivelable member 4 to the swivel center of the swivelable member 4.

In each steering means, each swivelable member 4 is provided with an eccentric hole, and the connecting rod 3 is provided with a pin shaft capable of being inserted into the eccentric hole to hinge each swivelable member 4 and the connecting rod 3 together.

In each steering means, each swivelable member 4 is a swivelable cylinder swivelably mounted on the vehicle body, with the eccentric hole being provided at a position offset from the swivel center of the swivelable cylinder.

In each steering means, the steering drive means 1 is a servo drive, and the pivot rod 2 is connected to an output shaft of the servo drive.

Embodiment II

Figure 2:
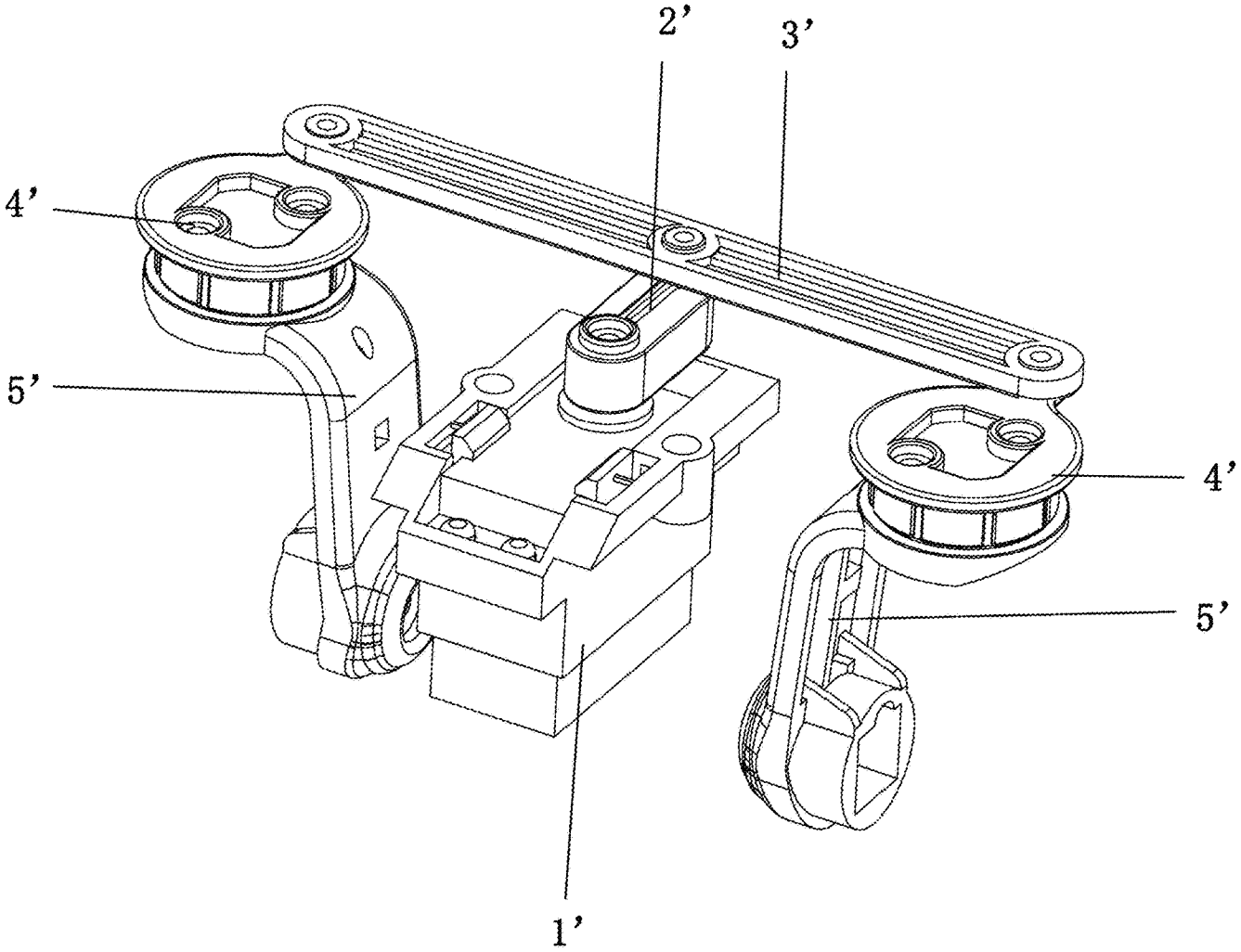
FIG. 2 is a perspective view of a steering means in Embodiment II of the present invention.

A difference between this embodiment and Embodiment I is as follows: as shown in FIG. 2, a wheel bracket 5' in this embodiment has a distinct shape compared to the wheel bracket in Embodiment I.

REFERENCED PARTS

1, 1' Steering drive means
2, 2' Pivot rod
3, 3' Connecting rod
4, 4' Swivelable member
5, 5' Wheel bracket

The invention claimed is:

1. An omnidirectional adjustable steering mechanism of a remote controlled toy vehicle, comprising:

a plurality of steering means, each steering means comprising a steering drive means, a pivot rod, a connecting rod, at least one swivelable member, and at least one wheel bracket, with the number of swivelable members and the number of wheel brackets being equal;

wherein in each steering means, the pivot rod is connected at a first end to a power output end of the steering drive means and hinged at a second end to a middle of the connecting rod, each swivelable member is swivelably mounted on a vehicle body of the remote-controlled toy vehicle and hinged to the connecting rod at a hinge position offset from a swivel center of the swivelable member, and each wheel bracket is fixedly connected at an upper end to a corresponding swivelable member.

2. The omnidirectional adjustable steering mechanism of a remote-controlled toy vehicle as claimed in claim 1, wherein in each steering means, a length of the pivot rod is equal to a distance from the hinge position of each swivelable member to the swivel center of the swivelable member.

3. The omnidirectional adjustable steering mechanism of a remote-controlled toy vehicle as claimed in claim 1, wherein in each steering means, each swivelable member is provided with an eccentric hole, and the connecting rod is provided with a pin shaft capable of being inserted into the eccentric hole to hinge each swivelable member and the connecting rod together.

4. The omnidirectional adjustable steering mechanism of a remote-controlled toy vehicle as claimed in claim 3, wherein in each steering means, each swivelable member is a swivelable cylinder, with the eccentric hole being provided at a position offset from the swivel center of the swivelable cylinder.

5. The omnidirectional adjustable steering mechanism of a remote-controlled toy vehicle as claimed in claim 3, wherein in each steering means, each swivelable member is a pivot arm having a pivot end and a fixed end fixedly connected to a corresponding wheel bracket, with the eccentric hole being provided at the pivot end of the pivot arm.

6. The omnidirectional adjustable steering mechanism of a remote-controlled toy vehicle as claimed in claim 3, wherein in each steering means, there are two swivelable members, and each of two ends of the connecting rod is hinged to the eccentric hole of the corresponding swivelable member.

7. The omnidirectional adjustable steering mechanism of a remote-controlled toy vehicle as claimed in claim 1, wherein in each steering means, the steering drive means is a servo drive or servo electric motor, and the pivot rod is connected to an output shaft of the servo drive or servo electric motor.

* * * * *